US010531754B2

(12) United States Patent
Rao

(10) Patent No.: US 10,531,754 B2
(45) Date of Patent: Jan. 14, 2020

(54) MODIFIED FOLDING DISPOSABLE COFFEE CUP SLEEVE

(71) Applicant: RAO INNOVATIONS LLC, Pacific Palisades, CA (US)

(72) Inventor: Vijendra Rao, Pacific Palisades, CA (US)

(73) Assignee: RAO Innovations LLC, Pacific Palisades, CA (US)

( * ) Notice: Subject to any disclaimer, the term of this patent is extended or adjusted under 35 U.S.C. 154(b) by 40 days.

(21) Appl. No.: 15/466,598

(22) Filed: Mar. 22, 2017

(65) Prior Publication Data

US 2017/0273485 A1 Sep. 28, 2017

Related U.S. Application Data

(60) Provisional application No. 62/312,944, filed on Mar. 24, 2016.

(51) Int. Cl.
*B65D 81/38* (2006.01)
*A47G 23/02* (2006.01)

(52) U.S. Cl.
CPC ..... *A47G 23/0216* (2013.01); *B65D 81/3876* (2013.01); *A47G 2023/0291* (2013.01)

(58) Field of Classification Search
CPC .... A61J 1/16; Y10S 220/903; A47G 23/0216; A47G 2023/0291; B65D 81/3806; B65D 81/3876; B65D 81/3879
USPC ..... 229/403; 220/592.2, 738, 739, 903, 737
See application file for complete search history.

(56) References Cited

U.S. PATENT DOCUMENTS

| | | | | |
|---|---|---|---|---|
| 2,794,545 | A | 6/1957 | Olson et al. | |
| 5,469,983 | A | 11/1995 | Yawata | |
| 7,922,031 | B1 | 4/2011 | Prince | |
| 8,210,392 | B2 | 7/2012 | Kang et al. | |
| 8,286,824 | B2 | 10/2012 | Ikeda et al. | |
| D670,542 | S | 11/2012 | Lee | |
| 8,523,008 | B2 | 9/2013 | Kim et al. | |
| 8,727,296 | B1 | 5/2014 | Dyer | |
| 8,887,945 | B2 | 11/2014 | Kao | |
| D753,959 | S | 4/2016 | Bremer | |
| 2002/0158074 | A1 | 10/2002 | Yawata | |
| 2009/0272753 | A1 | 11/2009 | Rebelak, Sr. et al. | |
| 2010/0019023 | A1* | 1/2010 | Silverstein | B65D 81/3876 229/403 |
| 2010/0224641 | A1 | 9/2010 | Hanel | |
| 2011/0114657 | A1 | 5/2011 | Nygaard | |

FOREIGN PATENT DOCUMENTS

| | | | | |
|---|---|---|---|---|
| DE | 10150689 | * | 4/2003 | B65D 81/38 |

* cited by examiner

*Primary Examiner* — Andrew T Kirsch
*Assistant Examiner* — Elizabeth J Volz
(74) *Attorney, Agent, or Firm* — Martin & Ferraro, LLP

(57) ABSTRACT

A disposable insulator for a cup having a sleeve including an insulating material to provide thermal insulation to the exterior of the cup, the sleeve having at least one finger pad made of the insulating material having a bottom edge, the finger pad being separable from the remainder of the sleeve and moveable from a first position to a second position, in the first position, the bottom edge of the finger pad being proximate to the bottom edge of the sleeve, and, in the second position the finger pad being foldable relative to the sleeve with the bottom edge of the finger pad positionable proximate to the top edge of the sleeve.

20 Claims, 9 Drawing Sheets

MODIFIED FOLDING DISPOSABLE COFFEE CUP SLEEVE

CROSS REFERENCE TO RELATED APPLICATIONS

This application claims the benefit of U.S. Provisional Application No. 62/312,944, filed Mar. 24, 2016; which is incorporated by reference herein.

BACKGROUND OF THE INVENTION

The present invention is generally directed to a disposable insulator for providing thermal insulation from the contents of a container, such as a cup.

Disposable coffee cup sleeves presently available are unable to sufficiently insulate the heat dissipated from a hot liquid, such as hot coffee or hot tea, in the cup because the cup sleeves are either too thin or made of a material that is insufficient to provide thermal insulation from the contents of the cup.

Coffee mugs, travel mugs, and disposable cups are used when carrying a beverage from one place to another. The overall build and material of the mugs enable a user to carry both cold and hot beverages. Similarly, the disposable cups can also be used to carry cold beverages. While the non-disposable coffee cups may have a robust construction and a lower heat transfer index, the disposable coffee cups typically have thin walls and a higher heat transfer index. As such, the build and material of the existing disposable cups require the user to take additional measures to protect the hands when carrying hot beverages. For example, the user may use multiple disposable cup sleeves if the beverage is very hot, which is both wasteful and expensive. Even though the existing cup sleeves are efficient when holding mildly warm beverages, the cup sleeves might not be as effective when holding extremely hot beverages, such as hot coffee or hot tea, because of the minimal thickness or material of the cup sleeves.

The insufficient protection to the hands of the user is the most common disadvantage with the existing cup sleeves. More specifically, the minimal thickness in existing cup sleeves result in the heat transferring from the beverage to the exterior surface of the cup, and then towards the hand of the user. In order to address this issue, users generally use multiple cup sleeves to protect the fingers holding the cup, which is both wasteful and expensive. Even though the use of multiple sleeves can be effective to some extent, the overall bulky structure resulting from multiple sleeves can be a burden when carrying a hot beverage in the disposable cup. The increased circumference due to the use of multiple sleeves also limits the use of cup holders which are designed according to pre-determined values.

An objective of the present invention is to address the aforementioned issues. The present invention eliminates the need to have multiple sleeves to protect the hand of the user against the hot beverage. Moreover, the present invention provides more insulation when holding the cup carrying the hot beverage so that the user can handle the disposable cup. Therefore, by utilizing the present invention, the user can carry the hot beverage as preferred and also protect the hand against the heat from the hot beverage.

SUMMARY OF THE INVENTION

The present invention contemplates a disposable insulator for a cup. In one embodiment, the disposable insulator includes a sleeve including an insulating material to provide thermal insulation to the exterior of the cup, the sleeve having a top edge, a bottom edge, an inner surface, and an outer surface having a thickness therebetween, the sleeve being tapered from the top edge to the bottom edge and configured to surround at least a portion of the cup. The disposable insulator preferably includes at least one finger pad made of the insulating material having a bottom edge, the finger pad being separable from the remainder of the sleeve and movable from a first position to a second position. In the first position, the bottom edge of the finger pad being proximate to the bottom edge of the sleeve, and in the second position, the finger pad being separated from at least a portion of the remainder of the sleeve and movable relative to the remainder of the sleeve, in the second position the finger pad being foldable relative to the sleeve with the bottom edge of the finger pad positionable proximate to the top edge of the sleeve. When in the second position, the folding of the finger pad increases the thickness of the insulation material present at the finger pad to create an area of increased insulation on the sleeve to provide additional thermal insulation to a portion of the exterior of the cup.

The present invention also contemplates a method of using a disposable insulator for a cup. In one embodiment, the method includes providing the disposable insulator for the cup. The disposable insulator includes a sleeve including an insulating material to provide thermal insulation to the exterior of the cup, the sleeve having a top edge, a bottom edge, an inner surface, and an outer surface having a thickness therebetween, the sleeve being tapered from the top edge to the bottom edge and configured to surround at least a portion of the cup, and at least one finger pad made of the insulating material having a bottom edge, the finger pad being separable from the remainder of the sleeve and movable from a first position to a second position. In the first position, the bottom edge of the finger pad being proximate to the bottom edge of the sleeve, and in the second position, the finger pad being separated from at least a portion of the remainder of the sleeve and movable relative to the remainder of the sleeve, in the second position the finger pad being foldable relative to the sleeve with the bottom edge of the finger pad positionable proximate to the top edge of the sleeve. When in the second position, the folding of the finger pad increases the thickness of the insulation material present at the finger pad to create an area of increased insulation on the sleeve to provide additional thermal insulation to a portion of the exterior of the cup. The method also includes moving the finger pad from the first position to the second position thereby creating the area of increased insulation on the sleeve.

In another embodiment, the present invention also contemplates the insulating material including perforations to create a separation zone to permit separation of at least a portion of the finger pad from the remainder of the sleeve. The present invention further contemplates the folding of the finger pad including folding the bottom edge of the finger pad over the top edge of the sleeve to secure the finger pad to the sleeve. The present invention additionally contemplates the finger pad of the insulation material including two folds allowing the bottom edge of the finger pad to fold over the top edge of the sleeve. The present invention also contemplates a portion of the bottom edge of the finger pad including an adhesive to further secure the finger pad to the sleeve. In another embodiment, the present invention further includes, when in the second position, the bottom edge of the finger pad being proximate to the top edge of the sleeve. The present invention additionally contemplates the bottom edge of the finger pad including at least one extension. The present invention also contemplates the extension of the bottom edge of the finger pad folding over the top edge of the sleeve to secure the finger pad to the sleeve. The present invention further contemplates the bottom edge of the finger pad having two extensions, the bottom edge of the finger pad having a recessed edge between the two extensions. The present invention additionally contemplates the finger pad including a first fold line, a first sidewall, and a second sidewall. The present invention also contemplates the first sidewall and the second sidewall of the finger pad being tapered from the bottom edge to the first fold line of the finger pad. The present invention further contemplates the bottom edge of the finger pad including two side extensions and a middle portion. The present invention additionally contemplates, when in the second position, the two side extensions folding over the top edge of the sleeve to secure the finger pad to the sleeve and the middle portion folding between the finger pad and the sleeve. The present invention also contemplates, when in the second position, the two side extensions folding over the top edge of the sleeve to secure the finger pad to the sleeve and the middle portion folding away from the sleeve. The present invention further contemplates the bottom edge of the finger pad including a concave recess that provides a gripping surface. The present invention additionally contemplates the folding of the finger pad including rolling a portion of the insulation material. The present invention also contemplates the folding of the finger pad including folding a portion of the insulation material into an accordion-shape. In an embodiment of the present invention, when in the first position, the bottom edge of the finger pad being even with the bottom edge of the sleeve. In another embodiment of the present invention, when in the first position, the bottom edge of the finger pad being offset with the bottom edge of the sleeve.

BRIEF DESCRIPTION OF THE DRAWINGS

The accompanying drawings, which are included to provide further understanding of the present invention disclosed in the present disclosure and are incorporated in and constitute a part of this specification, illustrate aspects of the present invention and together with the description serve to explain the principles of the present invention. In the drawings.

DETAILED DESCRIPTION

The detailed description set forth below is intended as a description of various configurations of the present invention and is not intended to represent the only configurations in which the present invention may be practiced. It will be apparent, however, to those of ordinary skill in the art that the present invention is not limited to the specific details set forth herein and may be practiced without these specific details.

Figure 1A:
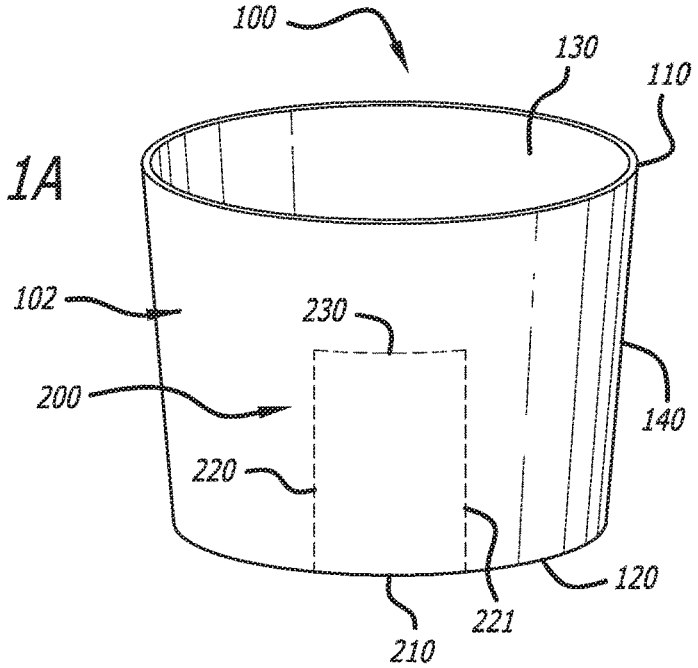
FIG. 1A is a perspective view of a disposable insulator in the form of a sleeve with a finger pad in accordance with a first embodiment of the present invention.

FIGS. 1A-4, 19, and 20 illustrate perspective and cross-sectional views of a disposable insulator 100 including a sleeve 102 in accordance with the first embodiment of the present invention. As shown in FIG. 1A, disposable insulator 100 includes sleeve 102 having a top edge 110, a bottom edge 120, an inner surface 130, and an outer surface 140.

Preferably, sleeve 102 includes or is formed at least in part of an insulating material to provide thermal insulation to the exterior of a cup C. Examples of insulating materials may include paper, double-walled paper, cardboard, corrugated cardboard, styrofoam, polystyrene, foam, acrylic, plastic, and any material with insulating properties suitable for the intended purpose and understood by one of ordinary skill in the art. Sleeve 102 may also be tapered from top edge 110 to bottom edge 120 to correspond to the shape of cup C and configured to surround at least a portion of cup C. Inner surface 130 and outer surface 140 of sleeve 102 may include advertisements such as brand names and logos.

Disposable insulator 100 preferably includes at least one finger pad 200 in accordance with the first embodiment of the present invention. Finger pad 200 may be made of the same insulating material of sleeve 102 or of a different material and may include a bottom edge 210, a first sidewall 220, a second sidewall 221, and a first fold line 230. First sidewall 220 and second sidewall 221 may include perforations in the insulating material to create a separation zone to permit separation of at least a portion of finger pad 200 from the remainder of sleeve 102. The perforations in the insulating material may be made from a die-cutting process, a laser-cutting process, or any process suitable for the intended purpose and understood by one of ordinary skill in the art. Finger pad 200 may be separable from the remainder of sleeve 102 and be movable from a first position to a second position in the direction of arrows A and B in FIGS. 2 and 4.

Figure 1B:
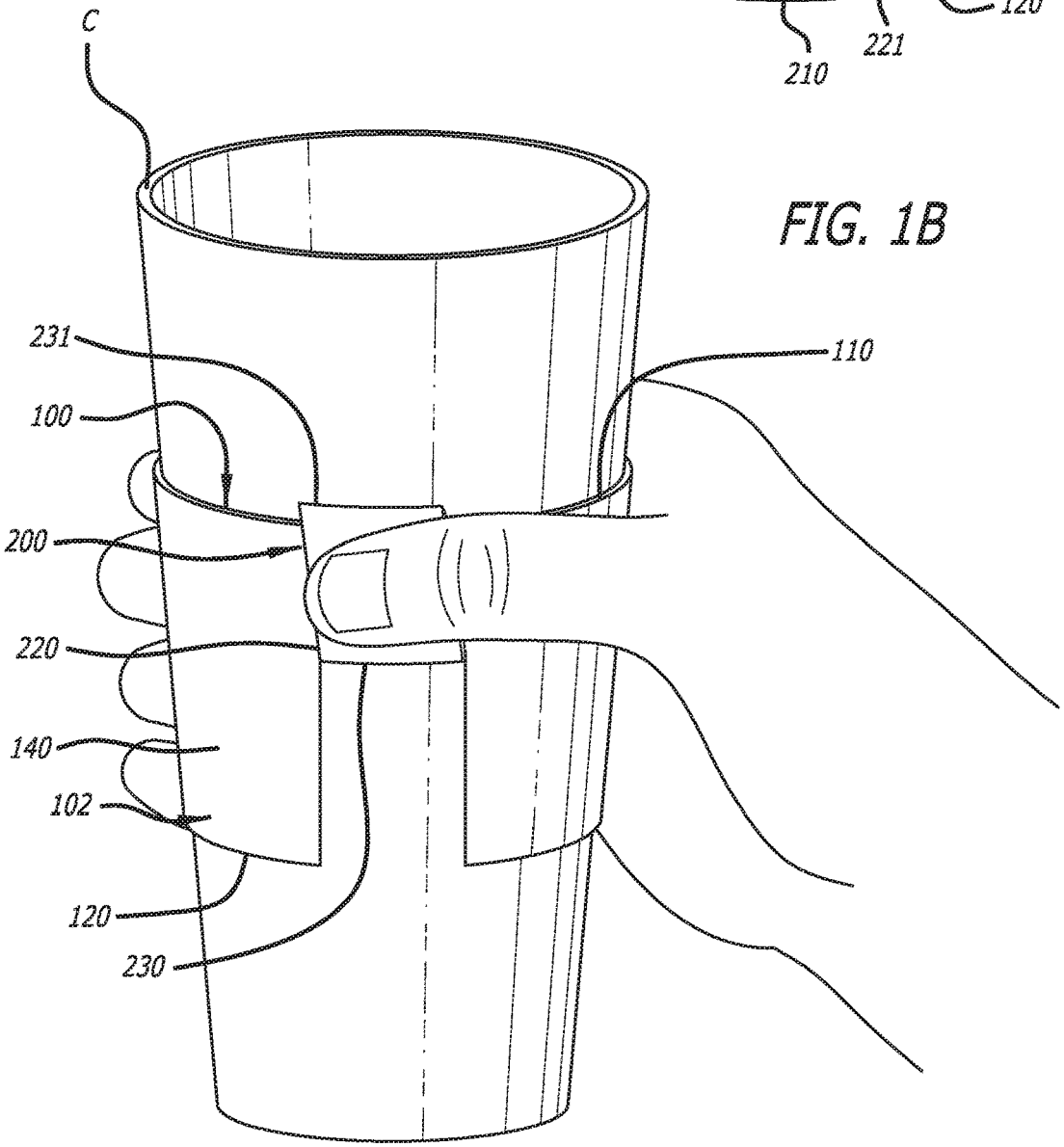
FIG. 1B is a perspective view of the disposable insulator surrounding a portion of a cup in accordance with the first embodiment of the present invention.

In the first position, bottom edge 210 of finger pad 200 may be proximate to bottom edge 120 of sleeve 102. For example, bottom edge 210 of finger pad 200 may be even with bottom edge 120 of sleeve 102 as shown in FIG. 1.

In the second position, finger pad 200 may be separate from at least a portion of the remainder of sleeve 102 and movable relative to the remainder of sleeve 102. In the second position, finger pad 200 also may be foldable relative to sleeve 102 with bottom edge 210 of finger pad 200 being positionable proximate to top edge 110 of sleeve 102. In the second position, bottom edge 210 of finger pad 200 may be perpendicular to sleeve 102, 45 degrees from top edge 110 or bottom edge 120 of sleeve 102, or any degree or position suitable for the intended purpose and understood by one of ordinary skill in the art. Finger pad 200 may transition from the first position to the second position along first fold line 230. In the second position, if any advertisements are present on inner surface 130 of sleeve 102, such advertisements may be displayed to a user.

Figure 2:
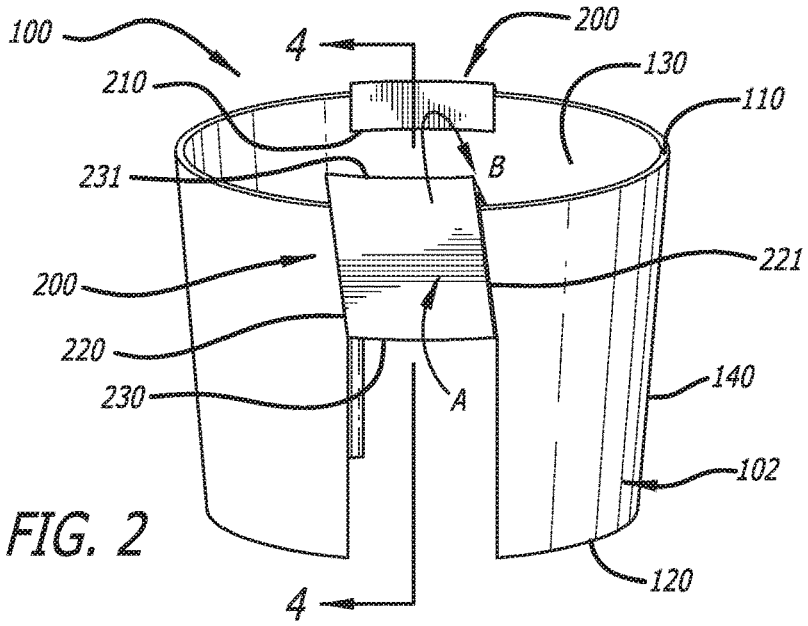
FIG. 2 is a perspective view of the disposable insulator with two finger pads in accordance with the first embodiment of the present invention.
Figure 3:
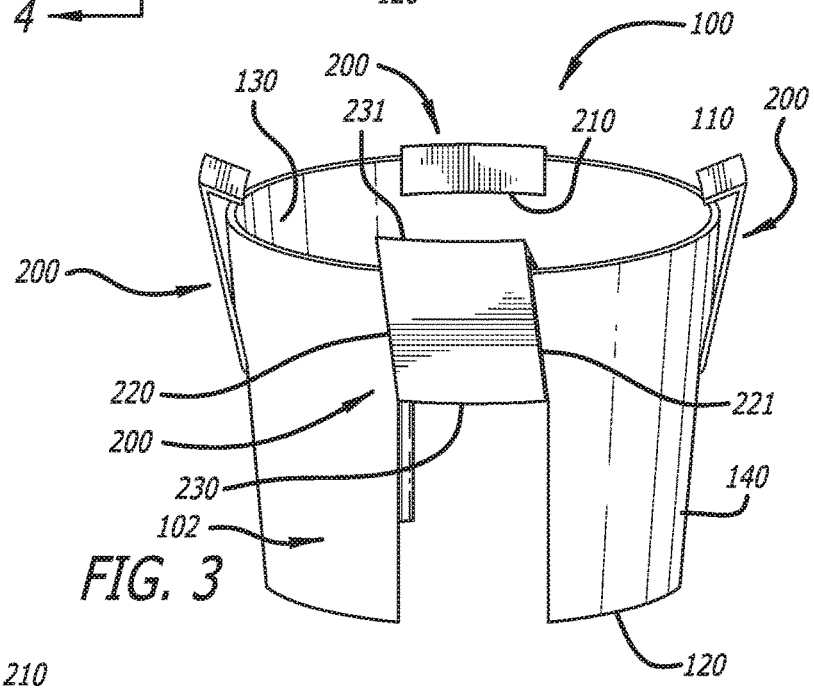
FIG. 3 is a perspective view of the disposable insulator with four finger pads in accordance with the first embodiment of the present invention.
Figure 4:
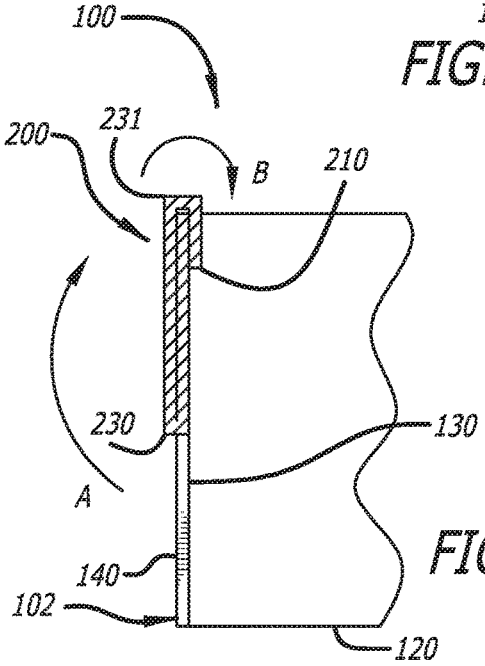
FIG. 4 is a cross-sectional view of the disposable insulator taken along line 4-4 of FIG. 2.

Finger pad 200 also may include a second fold line 231, as shown in FIGS. 2-4, to allow at least a portion of bottom edge 210 of finger pad 200 to fold over top edge 110 of sleeve 102. A portion of bottom edge 210 of finger pad 200 may include an adhesive to adhere to and further secure finger pad 200 to sleeve 102. The adhesive may be tape, double-sided tape, glue, hook-and-loop, or any type of adhesive suitable for the intended purpose and understood by one of ordinary skill in the art.

Furthermore, when finger pad 200 is in the second position, the folding of the insulation material of finger pad 200 increases the thickness of the insulation material present at finger pad 200. This creates an area of increased insulation on sleeve 102 to provide additional thermal insulation to a portion of the outer surface of cup C. The increased thickness of the insulation material present at finger pad 200 may be double-walled and inhibit heat transfer from hot contents in cup C. The user's fingers are spaced away from the exterior surface of cup C by the increased thickness of the insulation material and insulated from the hot contents of cup C. In this manner, the heat from the hot contents in cup C is less likely to reach the user. When in use, finger pad 200 also increases the holding area of sleeve 102 by creating a gripping area to allow the user to better hold or grip cup C with the finger pads of sleeve 102.

Figure 19:
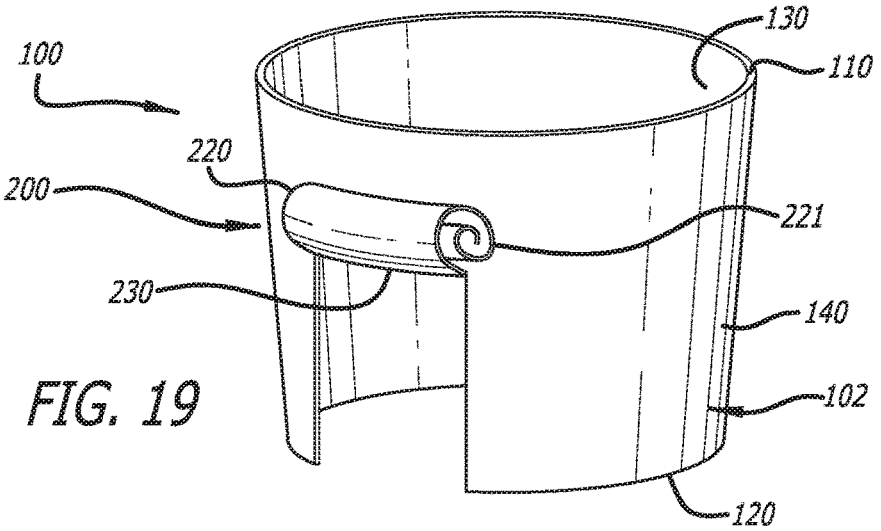
FIG. 19 is a perspective view of the disposable insulator with a rolled finger pad in accordance with the first embodiment of the present invention.
Figure 20:
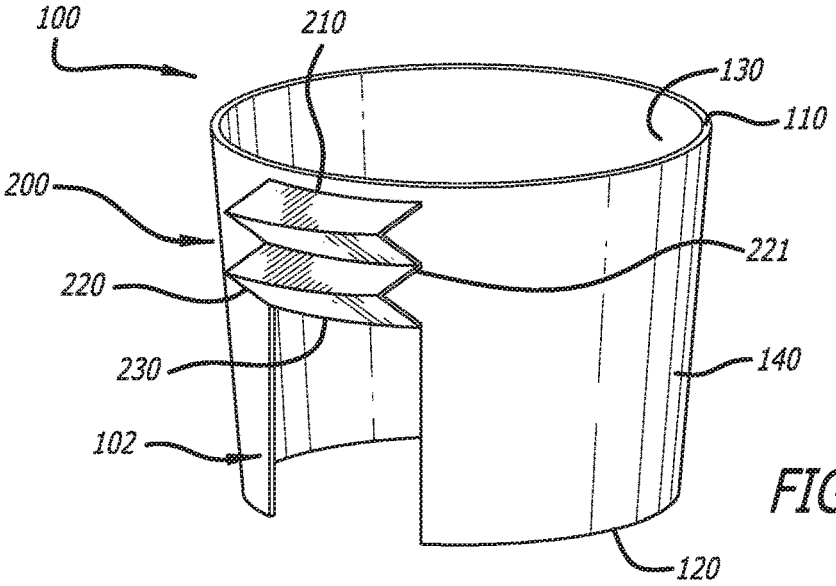
FIG. 20 is a perspective view of the disposable insulator with an accordion-shaped finger pad in accordance with the first embodiment of the present invention.

Finger pad 200 also may be movable and positioned in different configurations. Referring to FIG. 19, bottom edge 210 of finger pad 200 may be rolled towards top edge 110 of sleeve 102 to provide a rolled-up portion of additional thermal insulation to further inhibit heat transfer from the contents of cup C. As illustrated in FIG. 20, finger pad 200 may include additional folding lines to fold the insulation material into an accordion-shape to also provide additional thermal insulation from the contents of cup C by increasing the thickness of the insulation material present between the exterior surface of cup C and the user's finger.

Figure 5:
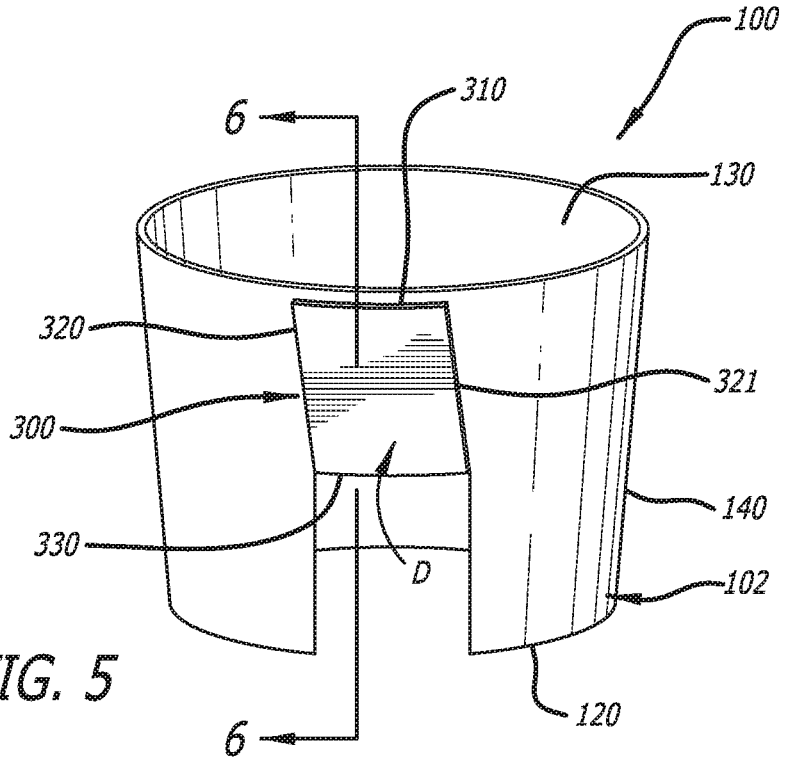
FIG. 5 is a perspective view of the disposable insulator in the form of a sleeve with a finger pad in accordance with a second embodiment of the present invention.
Figure 6:
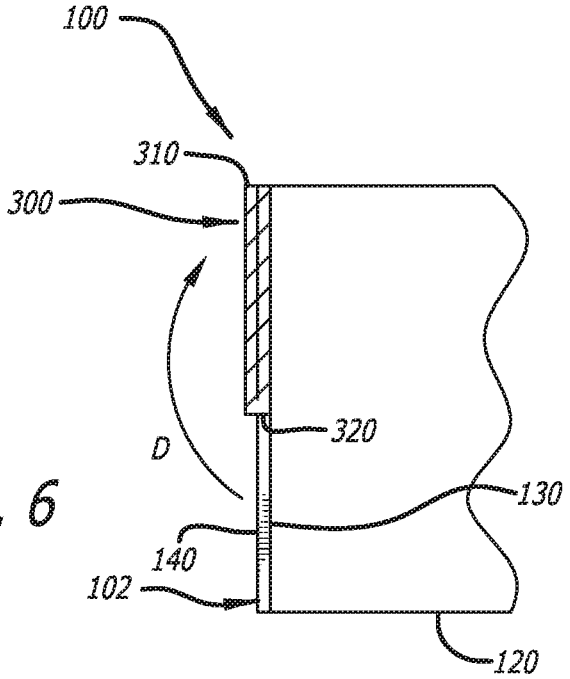
FIG. 6 is a cross-sectional view of the disposable insulator with a finger pad taken along line 6-6 of FIG. 5.

FIGS. 5 and 6 illustrate perspective and cross-sectional views of disposable insulator 100 including sleeve 102 in accordance with a second embodiment of the present invention.

Disposable insulator 100 preferably includes at least one finger pad 300 in accordance with the second embodiment of the present invention. Finger pad 300 also may be made of the same insulating material of sleeve 102 or of a different material and may include a bottom edge 310, a first sidewall 320, a second sidewall 321, and a fold line 330. First sidewall 320 and second sidewall 321 may include perforations in the insulating material to create a separation zone to permit separation of at least a portion of finger pad 300 from the remainder of sleeve 102. Finger pad 300 may be separable from the remainder of sleeve 102 and be movable from a first position to a second position in the direction of arrow D in FIGS. 5 and 6.

In the first position, bottom edge 310 of finger pad 300 may be proximate to bottom edge 120 of sleeve 102. In the second position, finger pad 300 may be separate from at least a portion of the remainder of sleeve 102 and movable relative to the remainder of sleeve 102. In the second position, finger pad 300 also may be foldable relative to sleeve 102 with bottom edge 310 of finger pad 300 being positionable proximate to top edge 110 of sleeve 102. Finger pad 300 may transition from the first position to the second position along fold line 330. A portion of bottom edge 310 of finger pad 300 may include an adhesive to adhere to and further secure finger pad 300 to sleeve 102.

Figure 7:
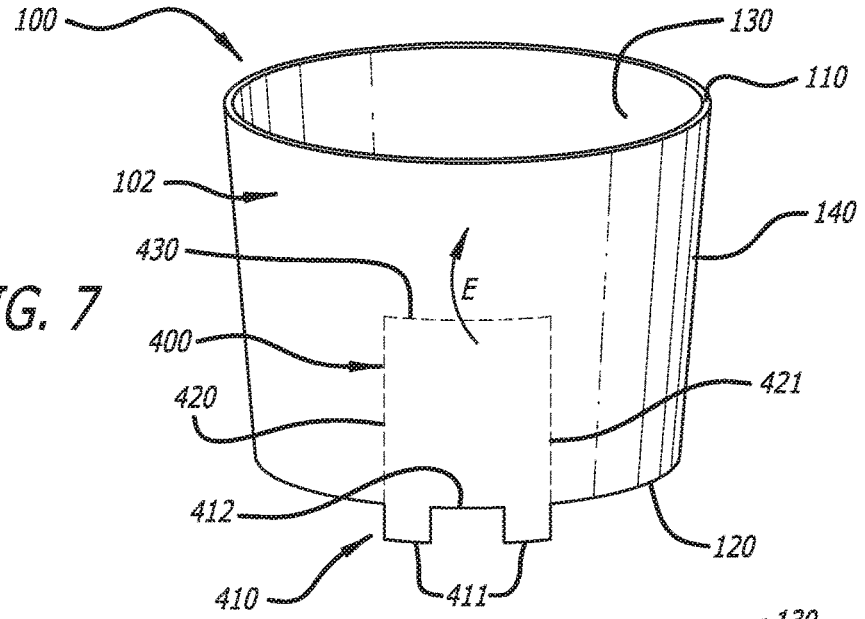
FIG. 7 is a perspective view of the disposable insulator with a finger pad in a first position in accordance with a third embodiment of the present invention.
Figure 8:
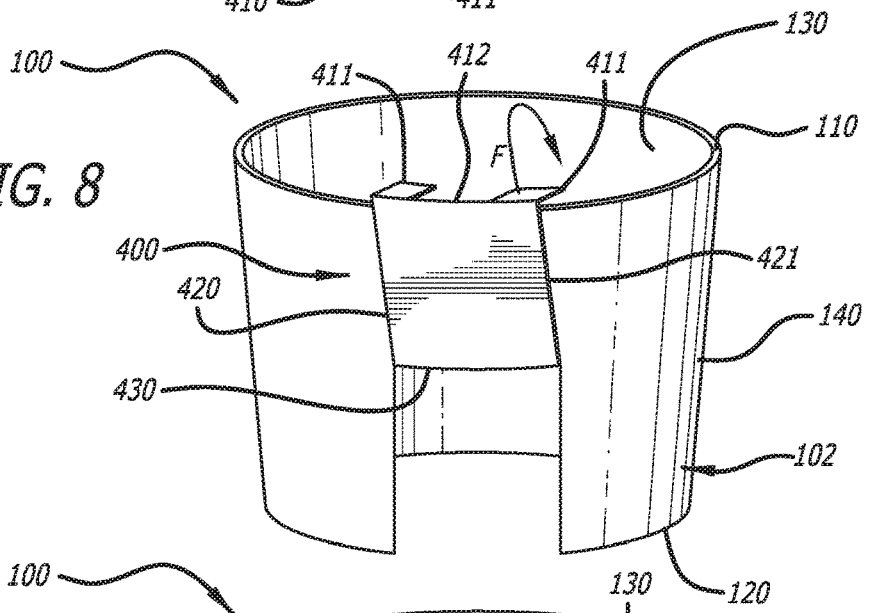
FIG. 8 is a perspective view of the disposable insulator with the finger pad in a second position in accordance with the third embodiment of the present invention.
Figure 9:
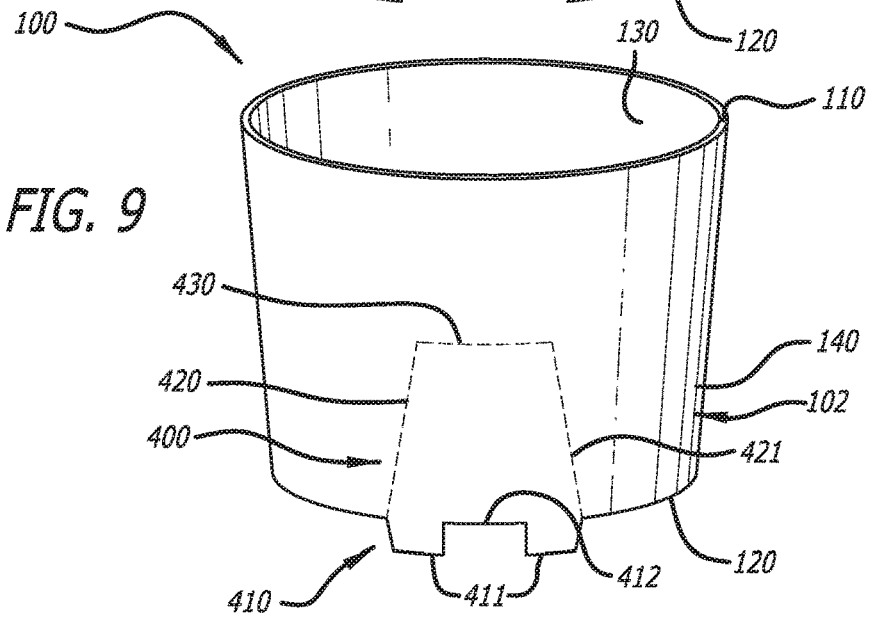
FIG. 9 is a perspective view of the disposable insulator with the finger pad having tapered sidewalls in accordance with the third embodiment of the present invention.
Figure 10:
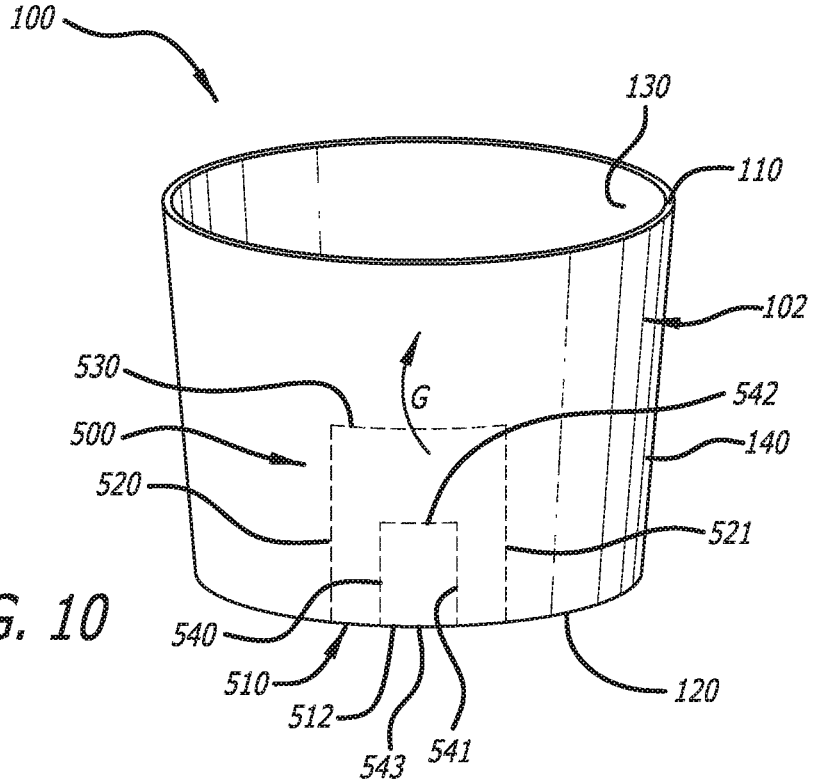
FIG. 10 is a perspective view of the disposable insulator with a finger pad in the first position and having a movable middle portion proximate a bottom edge of the finger pad in accordance with a fourth embodiment of the present invention.
Figure 11:
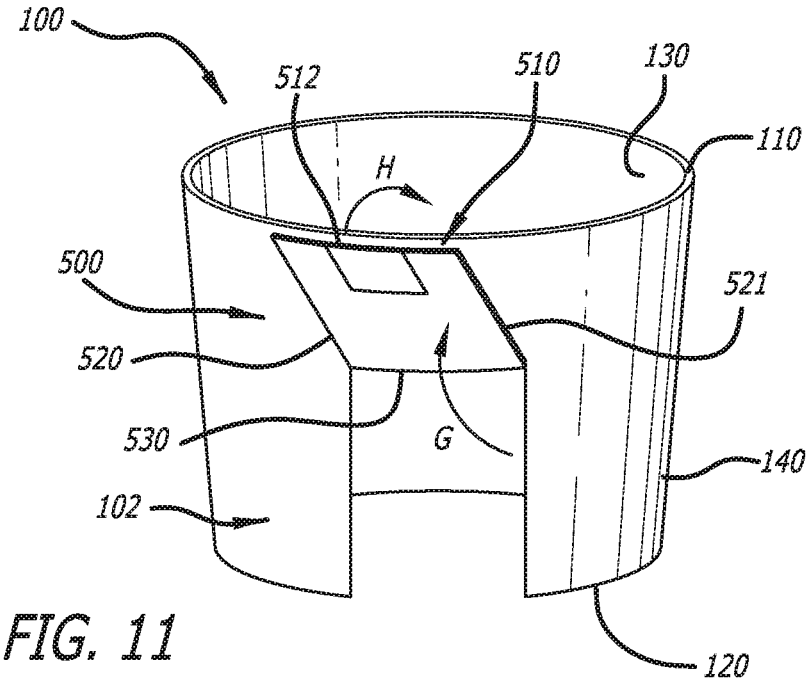
FIG. 11 is a perspective view of the disposable insulator with the finger pad in the second position in accordance with the fourth embodiment of the present invention.
Figure 12:
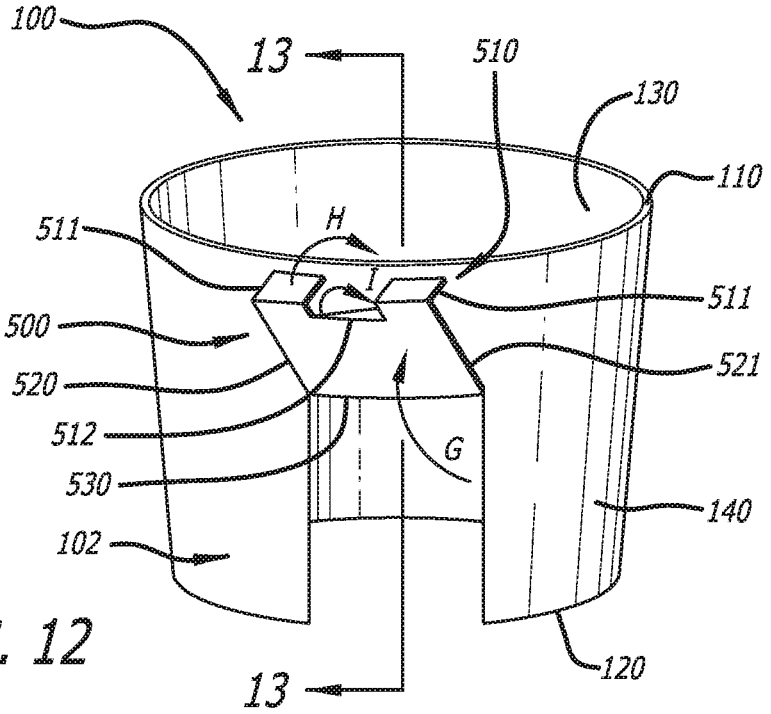
FIG. 12 is a perspective view of the disposable insulator with the movable middle portion of the finger pad being between the finger pad and the sleeve in accordance with the fourth embodiment of the present invention.
Figure 13:
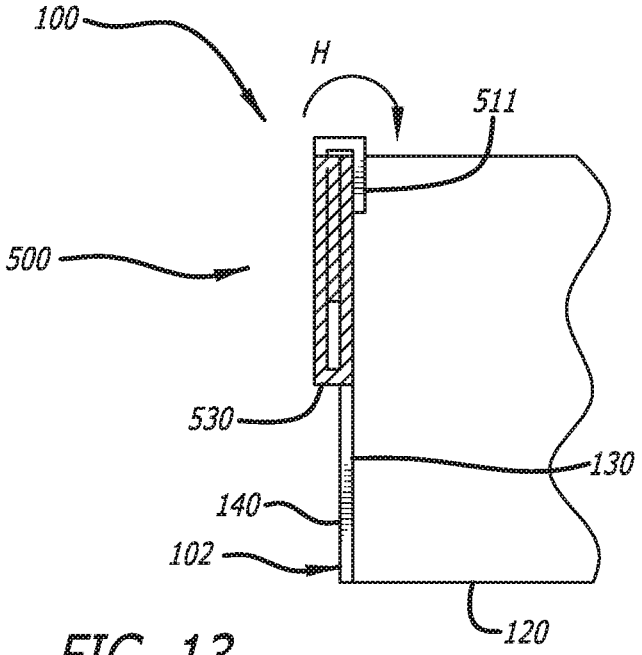
FIG. 13 is a cross-sectional view of the disposable insulator taken along line 13-13 of FIG. 12 with the finger pad in the second position, the movable middle portion of the finger pad being folded between the finger pad and the sleeve in accordance with the fourth embodiment of the present invention.
Figure 14:
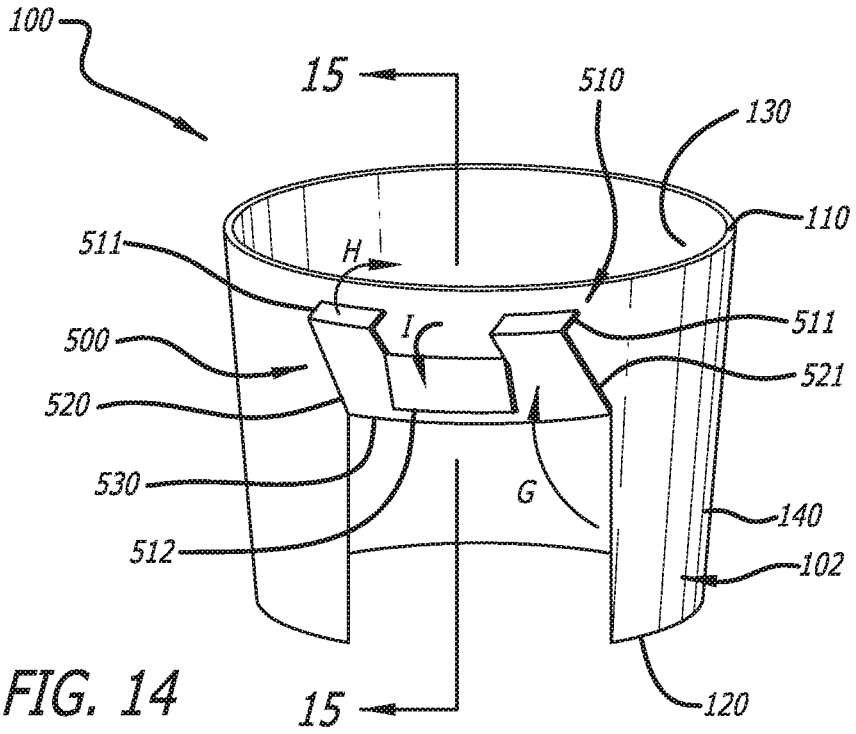
FIG. 14 is a perspective view of the disposable insulator with the movable middle portion of the finger pad being folded away from the sleeve in accordance with the fourth embodiment of the present invention.
Figure 15:
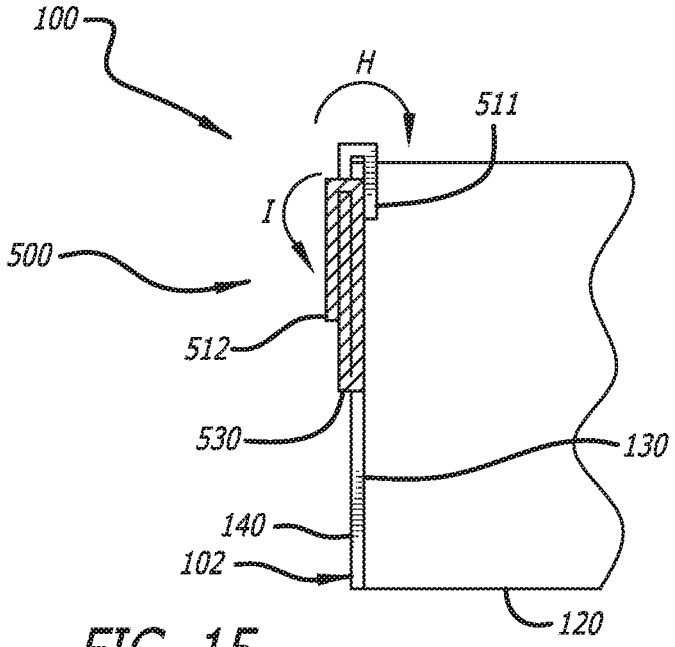
FIG. 15 is a cross-sectional view of the disposable insulator taken along line 15-15 of FIG. 14, showing the finger pad in the second position with the movable middle portion of the finger pad being folded away from the sleeve.

FIGS. 7-9 illustrate perspective views of disposable insulator 100 including sleeve 102 in accordance with a third embodiment of the present invention.

Disposable insulator 100 preferably includes at least one finger pad 400 in accordance with the third embodiment of the present invention. Finger pad 400 also may be made of the same insulating material of sleeve 102 or of a different material and may include a bottom edge 410, a first sidewall 420, a second sidewall 421 and a fold line 430. First sidewall 420 and second sidewall 421 may include perforations in the insulating material to create a separation zone to permit separation of at least a portion of finger pad 400 from the remainder of sleeve 102.

Bottom edge 410 of finger pad 400 may include at least one extension 411 made of the same insulating material of sleeve 102 or of a different material. Bottom edge 410 of finger pad 400 also may include two extensions 411 as shown in FIGS. 7 and 8. Two extensions 411 may include a recessed edge 412 therebetween. Finger pad 400 may be separable from the remainder of sleeve 102 and be movable from a first position to a second position in the direction of arrows E and F in FIGS. 7 and 8.

In the first position, bottom edge 410 of finger pad 400 may be proximate to bottom edge 120 of sleeve 102.

Extensions 411 of finger pad 400 may extend past bottom edge 120 of sleeve 102. In the second position, finger pad 400 may be separate from at least a portion of the remainder of sleeve 102 and movable relative to the remainder of sleeve 102. In the second position, finger pad 400 also may be foldable relative to sleeve 102 with bottom edge 410 of finger pad 400 being positionable proximate to top edge 110 of sleeve 102.

Finger pad 400 may transition from the first position to the second position along fold line 430. In the second position, extensions 411 of finger pad 400 may fold over top edge 110 of sleeve 102. A portion of extensions 411 of finger pad 400 may include an adhesive to adhere to and further secure finger pad 400 to sleeve 102.

First sidewall 420 and second sidewall 421 of finger pad 400 may be tapered from bottom edge 410 to fold line 430 of finger pad 400.

FIGS. 10-15 illustrate perspective and cross-sectional views of disposable insulator 100 including sleeve 102 in accordance with a fourth embodiment of the present invention.

Disposable insulator 100 preferably includes at least one finger pad 500 in accordance with the fourth embodiment of the present invention. Finger pad 500 also may be made of the same insulating material of sleeve 102 or of a different material and may include a bottom edge 510, a first sidewall 520, a second sidewall 521, and a fold line 530. First sidewall 520 and second sidewall 521 may include perforations in the insulating material to create a separation zone to permit separation of at least a portion of finger pad 500 from the remainder of sleeve 102. Finger pad 500 may be separable from the remainder of sleeve 102 and be movable from a first position to a second position in the direction of arrows G and H in FIGS. 10-15.

In the first position, bottom edge 510 of finger pad 500 may be proximate to bottom edge 120 of sleeve 102. In the second position, finger pad 500 may be separate from at least a portion of the remainder of sleeve 102 and movable relative to the remainder of sleeve 102. In the second position, finger pad 500 also may be foldable relative to sleeve 102 with bottom edge 510 of finger pad 500 being positionable proximate to top edge 110 of sleeve 102.

Finger pad 500 also may include a middle portion 512 that may also be made of the same insulating material of sleeve 102 or of a different material. Middle portion 512 may include a first sidewall 540, a second sidewall 541, and a fold line 542, similar to finger pad 500. First sidewall 540 and second sidewall 541 of middle portion 512 may include perforations in the insulating material to create a separation zone to permit separation of at least a portion of middle portion 512 from the remainder of finger pad 500. Middle portion 512 may be separable from the remainder of finger pad 500 and be movable from a first position to a second position in the direction of arrow I in FIGS. 12, 14, and 15.

As shown in FIGS. 12-15, in the first position, bottom edge 543 of middle portion 512 may be proximate to bottom edge 510 of finger pad 500. In the second position, middle portion 512 may be separate from at least a portion of the remainder of finger pad 500 and movable relative to the remainder of finger pad 500. In the second position, middle portion 512 also may be foldable relative to finger pad 500 with bottom edge 543 of middle portion 512 being positionable between finger pad 500 and sleeve 102 or away from sleeve 102.

When middle portion 512 is in the second position, finger pad 500 may have side extensions 511 at bottom edge 510 of finger pad 500. When finger pad 500 is in the second position, side extensions 511 may fold over top edge 110 of sleeve 102 to secure finger pad 500 to sleeve 102. A portion of side extensions 511 of finger pad 500 may include an adhesive to adhere to and further secure finger pad 500 to sleeve 102.

Figure 16:
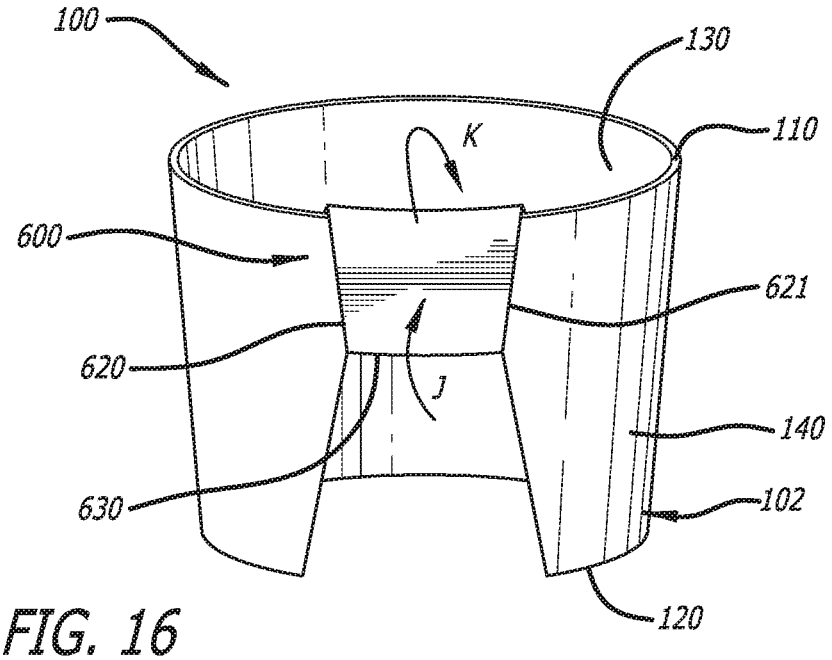
FIG. 16 is a perspective view of the disposable insulator with a finger pad in a first position in accordance with a fifth embodiment of the present invention.
Figure 17:
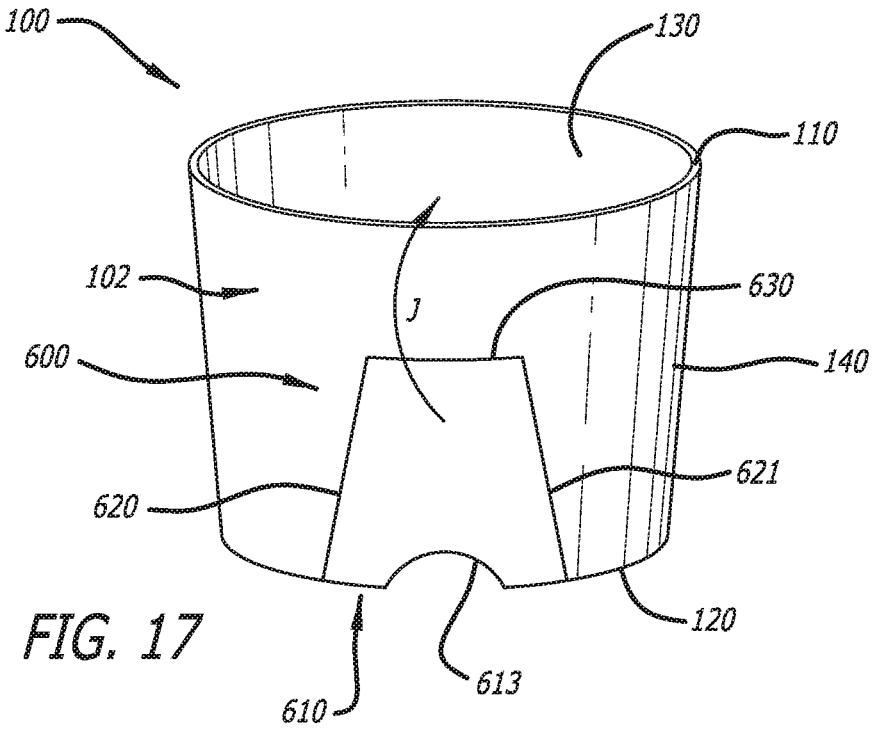
FIG. 17 is a perspective view of the disposable insulator with the finger pad in a second position in accordance with the fifth embodiment of the present invention.

FIGS. 16-17 illustrate perspective views of disposable insulator 100 including sleeve 102 in accordance with a fifth embodiment of the present invention.

Disposable insulator 100 preferably includes at least one finger pad 600 in accordance with the fifth embodiment of the present invention. Finger pad 600 also may be made of the same insulating material of sleeve 102 or of a different material and may include a bottom edge 610, a first sidewall 620, a second sidewall 621, and a fold line 630. First sidewall 620 and second sidewall 621 of finger pad 600 may be tapered from bottom edge 610 to fold line 630 of finger pad 600. First sidewall 620 and second sidewall 621 also may include perforations in the insulating material to create a separation zone to permit separation of at least a portion of finger pad 600 from the remainder of sleeve 102. Finger pad 600 may be separable from the remainder of sleeve 102 and be movable from a first position to a second position in the direction of arrows J and K in FIGS. 16 and 17.

In the first position, bottom edge 610 of finger pad 600 may be proximate to bottom edge 120 of sleeve 102. In the second position, finger pad 600 may be separate from at least a portion of the remainder of sleeve 102 and movable relative to the remainder of sleeve 102. In the second position, finger pad 600 also may be foldable relative to sleeve 102 with bottom edge 610 of finger pad 600 being position able proximate to top edge 110 of sleeve 102. In the second position, at least a portion of bottom edge 610 of finger pad 600 may fold over top edge 110 of sleeve 102.

Finger pad 600 may transition from the first position to the second position along fold line 630. A portion of bottom edge 610 of finger pad 600 may include an adhesive to adhere to and further secure finger pad 600 to sleeve 102.

As shown in FIG. 17, finger pad 600 also may include a recess section 613 to provide a gripping surface for finger pad 600. Recess section 613 of finger pad 600 may be in the shape of a concave recess or a square recess.

Figure 18:
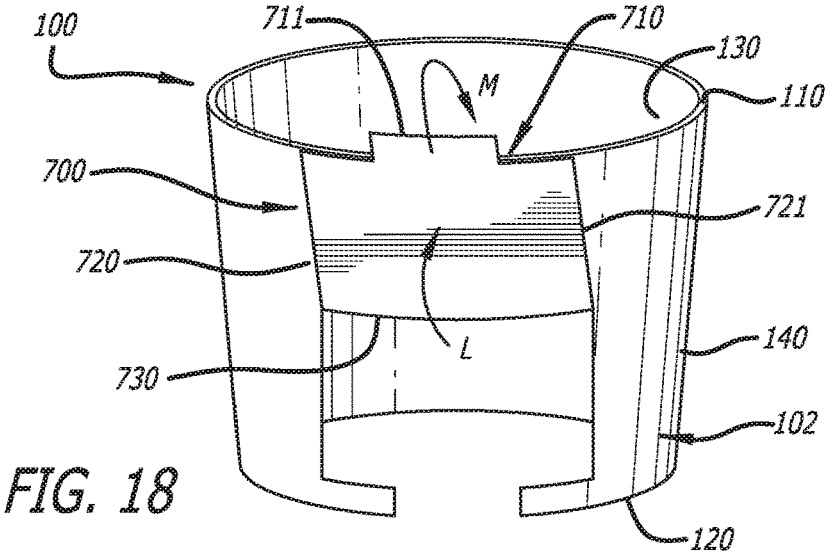
FIG. 18 is a perspective view of the disposable insulator with a finger pad in accordance with a sixth embodiment of the present invention.

FIG. 18 illustrates a perspective view of disposable insulator 100 including sleeve 102 in accordance with a sixth embodiment of the present invention.

Disposable insulator 100 preferably includes at least one finger pad 700 in accordance with the sixth embodiment of the present invention. Finger pad 700 also may be made of the same insulating material of sleeve 102 or of a different material and may include a bottom edge 710, a first sidewall 720, a second sidewall 721, and a fold line 730. Bottom edge 710, first sidewall 720, and second sidewall 721 also may include perforations in the insulating material to create a separation zone to permit separation of at least a portion of finger pad 700 from the remainder of sleeve 102. Finger pad 700 may be separable from the remainder of sleeve 102 and be movable from a first position to a second position in the direction of arrows L and M in FIG. 18.

In the first position, bottom edge 710 of finger pad 700 may be proximate to bottom edge 120 of sleeve 102. As shown in FIG. 18, bottom edge 710 of finger pad 700 may be offset from bottom edge 120 of sleeve 102. Bottom edge 120 of sleeve 102 may be interrupted as shown in FIG. 18.

In the second position, finger pad 700 may be separate from at least a portion of the remainder of sleeve 102 and movable relative to the remainder of sleeve 102. In the second position, finger pad 700 also may be foldable relative to sleeve 102 with bottom edge 710 of finger pad 700 being positionable proximate to top edge 110 of sleeve 102.

Finger pad 700 may transition from the first position to the second position along fold line 730. A portion of bottom edge 710 of finger pad 700 may include an adhesive to adhere to and further secure finger pad 700 to sleeve 102.

Side portions of bottom edge 710 of finger pad 700 also may be recessed and, when in the second position, the side portions of bottom edge 710 may be proximate to top edge 110 of sleeve 102 while a middle portion 711 of bottom edge 710 of finger pad 700 may fold over top edge 110 of sleeve 102.

Alternatively, bottom edge 120 of sleeve 102 may be continuous and uninterrupted when bottom edge 710 of finger pad 700 is offset from bottom edge 120 of sleeve 102. In this alternative example, an enclosed opening is formed in sleeve 102 when finger pad 700 is in the second position.

Alternatively, in the first position, bottom edge 210, 310, 410, 510, 610, 710 of finger pads 200, 300, 400, 500, 600, 700 may be proximate to top edge 110 of sleeve 102, and in the second position, bottom edge 210, 310, 410, 510, 610, 710 of finger pads 200, 300, 400, 500, 600, 700 may be positionable proximate to or foldable over bottom edge 120 of sleeve 102.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the broad scope of the appended claims.

What is claimed is:

1. A disposable insulator for a cup, the disposable insulator comprising:

a sleeve including an insulating material to provide thermal insulation to the exterior of the cup, the sleeve having a top edge, a bottom edge, an inner surface, and an outer surface having a thickness therebetween, the sleeve being tapered from the top edge to the bottom edge and configured to surround at least a portion of the cup; and at least one finger pad made of the insulating material having a bottom edge, the finger pad being separable from at least a portion of the remainder of the sleeve and moveable from a first position to a second position, in the first position, the bottom edge of the finger pad being proximate to the bottom edge of the sleeve, and in the second position, the finger pad being separated from at least a portion of the remainder of the sleeve and moveable relative to the remainder of the sleeve, in the second position the finger pad being folded relative to the sleeve with the bottom edge of the finger pad positioned at the top edge of the sleeve, wherein, when in the second position, the finger pad being folded increases the thickness of the insulation material present at the finger pad to create an area of increased insulation on the sleeve to provide additional thermal insulation to a portion of the exterior of the cup.

2. The disposable insulator of claim 1, wherein the insulating material includes perforations to create a separation zone to permit separation of at least a portion of the finger pad from the remainder of the sleeve.

3. The disposable insulator of claim 1, wherein the folded finger pad includes the bottom edge of the finger pad being folded over the top edge of the sleeve to secure the finger pad to the sleeve.

4. The disposable insulator of claim 3, wherein the finger pad includes two folds allowing the bottom edge of the finger pad to fold over the top edge of the sleeve.

5. The disposable insulator of claim 3, wherein a portion of the bottom edge of the finger pad includes an adhesive to further secure the finger pad to the sleeve.

6. The disposable insulator of claim 1, wherein the bottom edge of the finger pad includes at least one extension.

7. The disposable insulator of claim 6, wherein the extension of the bottom edge of the finger pad folds over the top edge of the sleeve to secure the finger pad to the sleeve.

8. The disposable insulator of claim 1, wherein the bottom edge of the finger pad has two extensions, the bottom edge of the finger pad having a recessed edge between the two extensions.

9. The disposable insulator of claim 1, wherein the finger pad includes a first fold line, a first sidewall, and a second sidewall.

10. The disposable insulator of claim 9, wherein the first sidewall and the second sidewall of the finger pad are tapered from the bottom edge to the first fold line of the finger pad.

11. The disposable insulator of claim 1, wherein the bottom edge of the finger pad includes two side extensions and a middle portion.

12. The disposable insulator of claim 11, wherein, when in the second position, the two side extensions fold over the top edge of the sleeve to secure the finger pad to the sleeve and the middle portion folds between the finger pad and the sleeve.

13. The disposable insulator of claim 11, wherein, when in the second position, the two side extensions fold over the top edge of the sleeve to secure the finger pad to the sleeve and the middle portion folds away from the sleeve.

14. The disposable insulator of claim 1, wherein the bottom edge of the finger pad includes a concave recess that provides a gripping surface.

15. The disposable insulator of claim 1, wherein the folded finger pad includes rolling a portion of the insulation material.

16. The disposable insulator of claim 1, wherein the folded finger pad includes folding a portion of the insulation material into an accordion-shape.

17. The disposable insulator of claim 1, wherein, when in the first position, the bottom edge of the finger pad is offset with the bottom edge of the sleeve.

18. A method of using a disposable insulator for a cup, the method comprising:

providing the disposable insulator for the cup, the disposable insulator comprising:

a sleeve including an insulating material to provide thermal insulation to the exterior of the cup, the sleeve having a top edge, a bottom edge, an inner surface, and an outer surface having a thickness therebetween, the sleeve being tapered from the top edge to the bottom edge and configured to surround at least a portion of the cup; and at least one finger pad made of the insulating material having a bottom edge, the finger pad being separable from at least a portion of the remainder of the sleeve and moveable from a first position to a second position, in the first position, the bottom edge of the finger pad being proximate to the bottom edge of the sleeve, and in the second position, the finger pad being separated from at least a portion of the remainder of the sleeve and moveable relative to the remainder of the sleeve, in the second position the finger pad being folded relative to the sleeve with the bottom edge of the finger pad positioned at the top edge of the sleeve, wherein, when in the second position, the folding of the finger pad increases the thickness of the insulation material present at the finger pad to create an area of increased insulation on the sleeve to provide additional thermal insulation to a portion of the exterior of the cup; and moving the finger pad from the first position to the second position thereby creating the area of increased insulation on the sleeve.

19. A disposable insulator for a cup, the disposable insulator comprising:

a sleeve including an insulating material to provide thermal insulation to the exterior of the cup, the sleeve having a top edge, a bottom edge, an inner surface, and an outer surface having a thickness therebetween, the sleeve being tapered from the top edge to the bottom edge and configured to surround at least a portion of the cup; and at least one finger pad made of the insulating material having a bottom edge, the finger pad being separable from at least a portion of the remainder of the sleeve and moveable from a first position to a second position, in the first position, the bottom edge of the finger pad being proximate to the bottom edge of the sleeve, and in the second position, the finger pad being separated from at least a portion of the remainder of the sleeve and moveable relative to the remainder of the sleeve, in the second position the finger pad being folded relative to the sleeve with the bottom edge of the finger pad positioned proximate to the top edge of the sleeve, wherein the folded finger pad includes the bottom edge of the finger pad being folded over the top edge of the sleeve to secure the finger pad to the sleeve, wherein, when in the second position, the finger pad being folded increases the thickness of the insulation material present at the finger pad to create an area of increased insulation on the sleeve to provide additional thermal insulation to a portion of the exterior of the cup.

20. A disposable insulator for a cup, the disposable insulator comprising:

a sleeve including an insulating material to provide thermal insulation to the exterior of the cup, the sleeve having a top edge, a bottom edge, an inner surface, and an outer surface having a thickness therebetween, the sleeve being tapered from the top edge to the bottom edge and configured to surround at least a portion of the cup; and at least one finger pad made of the insulating material having a bottom edge, the bottom edge of the finger pad including a concave recess that provides a gripping surface, the finger pad being separable from at least a portion of the remainder of the sleeve and moveable from a first position to a second position, in the first position, the bottom edge of the finger pad being proximate to the bottom edge of the sleeve, and in the second position, the finger pad being separated from at least a portion of the remainder of the sleeve and moveable relative to the remainder of the sleeve, in the second position the finger pad being folded relative to the sleeve with the bottom edge of the finger pad positioned proximate to the top edge of the sleeve, wherein, when in the second position, the finger pad being folded increases the thickness of the insulation material present at the finger pad to create an area of increased insulation on the sleeve to provide additional thermal insulation to a portion of the exterior of the cup.

* * * * *